US005197423A

United States Patent [19]

Ebesu et al.

[11] Patent Number: 5,197,423

[45] Date of Patent: Mar. 30, 1993

[54] ARRANGEMENT FOR DRIVING AT LEAST ONE SUPPLEMENTAL APPARATUS OF A V-TYPE ENGINE

[75] Inventors: Hidesaku Ebesu; Toshimichi Akagi; Naoki Nagano, all of Hiroshima, Japan

[73] Assignee: Mazda Motor Corporation, Hiroshima, Japan

[21] Appl. No.: 834,208

[22] Filed: Feb. 12, 1992

[30] Foreign Application Priority Data

Feb. 18, 1991 [JP] Japan ..... 3-043938

[51] Int. Cl.[5] ..... F02F 7/00

[52] U.S. Cl. ..... 123/195 A; 123/41.1; 123/198 C

[58] Field of Search ..... 123/195 A, 196 R, 198 R, 123/198 C, 41.09, 41.1, 41.44, 55 VF, 55 VS, 55 VE

[56] References Cited

U.S. PATENT DOCUMENTS 3,730,147 5/1973 Buchwald ..... 123/195 A

FOREIGN PATENT DOCUMENTS 60-230503 11/1985 Japan .

*Primary Examiner*—Noah P. Kamen

*Attorney, Agent, or Firm*—Keck, Mahin & Cate

[57] ABSTRACT

A V-type engine is constructed so that one bank of cylinders is located rearward, in a longitudinal direction of the engine, relative to the other bank of cylinders so that a space is formed in front of a front surface of a cylinder block of the engine. In the space, a casing or casings for a fluid passage are provided. Supplemental apparatuses, such as a water pump, an alternator, a compressor, and an oil pump, are formed so as to be driven by belts transmitting drive power from a crankshaft of the V-type engine. One of the belts has tension applied to it by a tensioner, which is formed on a bracket. The bracket is fixed to the casing or casings by bolts, which are used for both fixing the casing or casings to the cylinder block and for fixing the bracket to the casing or casings. As a result, both of the bracket and the casing or casings are firmly fixed to the cylinder block within a compact space, even when the tensioner is located far from the front surface of the cylinder block.

9 Claims, 5 Drawing Sheets

ARRANGEMENT FOR DRIVING AT LEAST ONE SUPPLEMENTAL APPARATUS OF A V-TYPE ENGINE

BACKGROUND OF THE INVENTION

1. Field of the Invention

This invention relates to an apparatus or arrangement for driving at least one supplemental apparatus by power supplied from what is known as a "V-type" engine. Generally, a V-type automobile engine includes two, i.e., left and right, cylinder banks arranged in a V-shaped formation. The cylinder banks are disposed at a predetermined relative angle, and each cylinder bank is formed with a plurality of cylinders arranged in a row. The row of cylinders in one of the two cylinder banks is typically offset relative to the row of cylinders in the other of the cylinder banks. Offsetting the rows of cylinders relative to each other provides what is called a "dead" space, i.e., an unused volume, at one end of the cylinder block. This dead space is located in front of a cylinder bank including one of the two rows of cylinders. To briefly explain the structure of a known offset V-type automobile engine, reference is now made to FIG. 1. An engine body, generally designated by reference number 1, is provided with two rows of cylinders 5. More specifically, each row of cylinders is provided in one of left and right cylinder banks 3 and 4, which are either rigidly secured to or integrally formed with an engine block 2. The rows of cylinders 5 extend lengthwise of the engine body and parallel to a crankshaft 6. The row of cylinders 5 in the right cylinder bank 4 is offset rearward relative to the row of cylinders 5 in the left cylinder bank 3 in a lengthwise or axial direction of the engine body, indicated by an arrow X, in which the crankshaft 6 extends. A dead space or unused volume A, located in front of the end of the right cylinder block 4, is provided by offsetting the row of cylinders 5 in the right cylinder block 4. Generally a passage is provided for introducing engine coolant into the engine body 1. When the engine coolant passage is located in the dead portion A, a thermostat casing 7, having a thermostat for regulating the temperature of the engine coolant, is necessarily secured to the front end of the right cylinder bank 4.

2. Description of Related Art

A V-type engine of the type as shown in FIG. 1 is typically provided with a plurality of supplemental apparatuses, such as a water pump, an alternator, a compressor for an air conditioner, an oil pump for power steering, and a compressor for a mechanical supercharger. These supplemental apparatuses are driven by a drive belt or drive belts operationally coupling pulleys connected to respective drive shafts of the supplemental apparatuses and a crank pulley 8 secured to the front end of the crankshaft 6. If the number of such supplemental apparatuses is relatively large and/or all or some of the supplemental apparatuses have high driving loads, the supplemental apparatuses are typically divided into at least two groups. These two supplemental apparatus groups are separately disposed on opposite sides of the crankshaft 6 and driven independently by two independent drive belts. Such a supplemental apparatus drive arrangement is known from, for instance, Japanese Unexamined Patent Publication No. 60-230,503. Belt tensioning or tension regulating means for the drive belt of the supplemental apparatus drive arrangement generally must be provided so that the supplemental apparatuses are properly driven. Such a belt tensioning or tension regulating means is needed unless a position adjustable alternator, which can be adjusted in position with respect to the cylinder block 2 so as to regulate a drive belt tension, or some other similarly adjustable supplemental apparatus, is used.

When using two or more drive belts to drive the supplemental apparatuses, the drive belts and their associated belt tensioning means should be offset in the lengthwise direction of the crankshaft relative to each other. Consequently, the belt tensioning means for the foremost drive belt, i.e., the drive belt which is disposed closest to the front end of the automobile, is located at a relatively long distance from the front end of the cylinder block. It is, therefore, difficult to properly position and secure the belt tensioning means for the foremost drive belt to the front end of the cylinder block.

SUMMARY OF THE INVENTION

It is an object of this invention to provide an improved arrangement for driving a supplemental apparatus or supplemental apparatuses, using power supplied by a V-type engine, which includes a belt tensioner fixed at a proper position with enough stiffness or rigidity to provide satisfactory operation.

It is another object of the invention to provide a drive arrangement for the supplemental apparatus or apparatuses, using power supplied by the V-type engine, which has parts disposed around a belt tensioner which are fixed with enough stiffness or rigidity to operate in a satisfactory manner.

The foregoing objects are accomplished, according to the present invention, by providing a drive arrangement for one or more than one supplemental apparatus of a V-type engine which includes a particular bracket for mounting a belt tensioner. The bracket is fixed to a casing or casings for fluid passages, such as cooling water and oil passages. The bracket is placed in front of one cylinder bank, which is located rearwardly of the vehicle relative to another cylinder bank. As a result, a dead space is utilized effectively. Bolts can be used, in common, to fix the casing or casings and the bracket together to a cylinder block.

In accordance with one particularly advantageous aspect of the present invention, a drive arrangement includes a water pump, as a supplemental apparatus, and a thermostat. The water pump and thermostat are fixed by a bracket for a belt tensioner so that desirable stiffness after assembly is provided.

BRIEF DESCRIPTION OF THE DRAWINGS

The manner in which the above and other objects are achieved, and various features of the present invention, will be apparent to those skilled in the art from the following description of a preferred embodiment thereof when considered in conjunction with the drawings associated with this application, in which.

DETAILED DESCRIPTION OF THE PREFERRED EMBODIMENT

Figure 1:
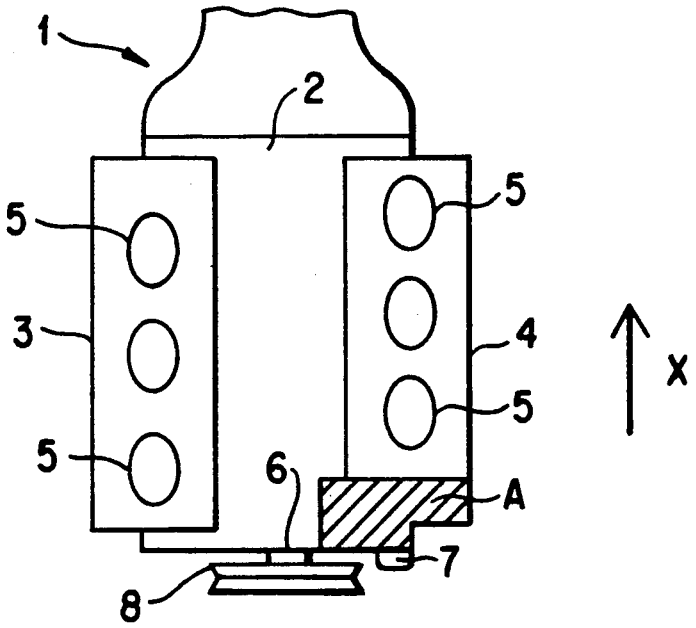
FIG. 1 PRIOR ART
FIG. 1, as was mentioned above, is a schematic plan view of a conventional V-type six cylinder engine.
Figure 2:
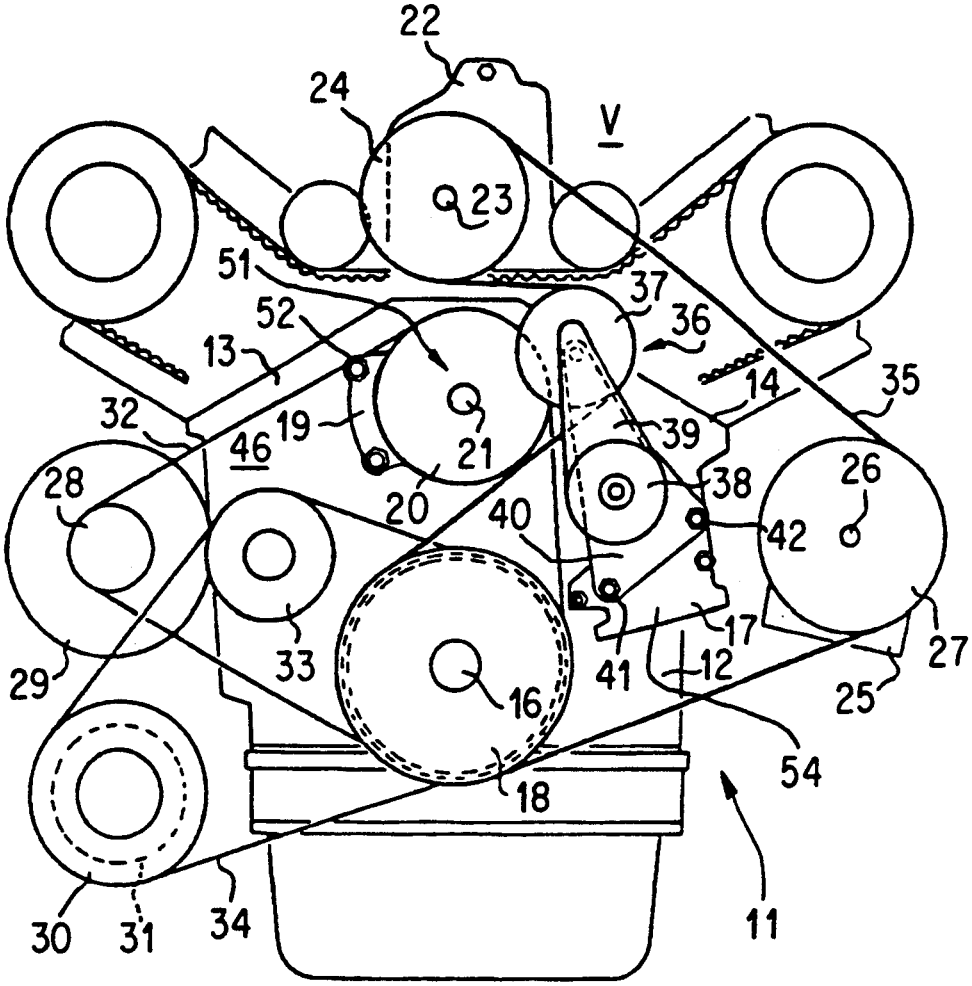
FIG. 2 is a schematic front view illustrating positions of supplemental apparatuses relative to a V-type engine according to an embodiment of the invention.

Referring to the drawings in detail and, in particular, to FIG. 2, an engine body 11 of a V-type internal combustion engine is shown as being equipped with a supplemental apparatus drive arrangement according to a preferred embodiment of the present invention. The engine includes left and right cylinder blocks or banks 13 and 14, respectively, arranged in a V-formation and at a predetermined relative angle so as to form a V-shaped space V therebetween. A plurality of cylinders (not shown) are formed in each of the left and right cylinder blocks 13 and 14. The cylinders in the left cylinder bank 13 and the cylinders in the right cylinder bank 14 are arranged in rows parallel to a crankshaft 16. As was the case in FIG. 1, one of the two rows of the cylinders, for instance the row of the cylinders in the right cylinder bank 14, is offset rearward in the lengthwise direction of the crankshaft 16 relative to the other row of the cylinders, namely, the row of the cylinders in the left cylinder bank 14. The engine 11 has a cylinder block 12, which mounts the crankshaft 16 for rotation. A drive crankshaft pulley 18, having three axially separated grooves, is secured at its center to the crankshaft 16. The engine body 11 is provided with a water pump casing 19 for covering a water pump 51. The water pump casing 19 is fastened, by securing bolts 52 or otherwise, to an upper portion of the front end of the cylinder block 12. The water pump 51 has a rotary drive shaft 21 extending outside of the water pump casing 19. The rotary drive shaft 21 has a driven or water pump pulley 20 secured to its outer end A mechanical supercharger 22, disposed in the V-shaped space V between the left and right cylinder banks 13 and 14, is attached to the engine 11 The mechanical supercharger has a rotary drive shaft 23, and a driven or supercharger pulley 24 is secured to one end of the drive shaft 23. The engine 11 is further provided with a thermostat casing 17 covering a thermostat (not shown). The thermostat casing is bolted or otherwise secured to the front end of the right cylinder bank 14.

Supplemental apparatuses, other than the water pump and the mechanical supercharger, may be associated with the engine body 11. Such supplemental apparatuses may include a compressor 25 for an air conditioner or air conditioning system, an alternator 29 and an oil pump 31 for a power steering system. The air conditioner compressor 25 has a rotary drive shaft 26. A driven or compressor pulley 27 is secured to one end of the drive shaft 26. Both rotary drive shaft 26 and compressor pulley 27 are disposed on the right hand side of the cylinder block 12, as it is illustrated in FIG. 2. The alternator 29 and the power steering oil pump 31 are disposed on and attached to the opposite side of the cylinder block 12, i.e., the left hand side of the cylinder block, with respect to the crankshaft 16. The alternator 29 has a driven or alternator pulley 28, and the power steering oil pump 31, disposed below the alternator 29, has a driven or oil pump pulley 30. The alternator 29 and the power steering oil pump 31 are adjustable in position with respect to the cylinder block 12 so as to regulate the tension of a belt by which the alternator and power steering oil pump are driven. An idle pulley 33 is located between the crankshaft pulley 18 having the three axially separated grooves and the alternator pulley 28 and is rotatably mounted on the front end of the cylinder block 12. A tensioning pulley 37 is located adjacent to and on the right hand side of the water pump pulley 20 and is rotatably supported by an arm 39 of an automatic tensioning means 36 which will be described later. All of the pulleys 18, 20, 24, 27, 28, 30, 33 and 37 have center axes of rotation parallel to the center axis of rotation of the crankshaft 16.

The water pump pulley 20 and the alternator pulley 28 are disposed in a first spatial plane parallel with and closely adjacent to the surface of the front end 46 of the cylinder block 12. Pulleys 20 and 28 are operationally connected or coupled to the crankshaft pulley 18 by a first drive bolt 32 fitting in a first groove of the crankshaft pulley 18. The first drive belt 32, therefore, transmits the engine output from the crankshaft 16 to the pulleys 20 and 28. The oil pump pulley 30 and the idle pulley 33 are disposed in a second spatial plane. The second spatial plane is parallel to and on a side of the first spatial plane opposite the surface of the front end 46 of the cylinder block 12. The second spatial plane, therefore, is more remote from the front end 46 than the first spatial plane. The oil pump pulley 30 and .the idle pulley 33 are operationally connected or coupled to the crankshaft pulley 18 by a second drive belt 34 fitting in a second groove of the crankshaft pulley 18. The second drive belt 34, therefore, transmits the engine output from the crankshaft 16 to the pulleys 30 and 33. The supercharger pulley 24, the compressor pulley 27 and the tensioning pulley 37 are disposed in a third spatial plane. The third spatial plane is parallel to and on a side of the first and second spatial planes opposite to the surface of the front end 46 of the cylinder block 12. The third spatial plane, therefore, is more remote from the front end 46 than both the first spatial plane and the second spatial plane. The supercharger pulley 24, the compressor pulley 27 and the tensioning pulley 37 are operationally connected or coupled to the crankshaft pulley 18 by a third drive belt 35 fitting in a third groove of the crankshaft pulley 18. The third drive belt 35, therefore, transmits the engine output from the crankshaft 16 to the pulleys 24 and 27. Automatic tensioning means 36, having the tensioning pulley 37, is located between the crankshaft pulley 18 and the supercharger pulley 24 and on the right hand side of the oil pump pulley 20. The automatic tensioning means 36 is bolted, or otherwise secured, to the front end of the cylinder block 12 and is structured to urge the tensioning pulley 37 against the third drive belt 35 to regulate tension of the third drive belt 35.

Figure 3:
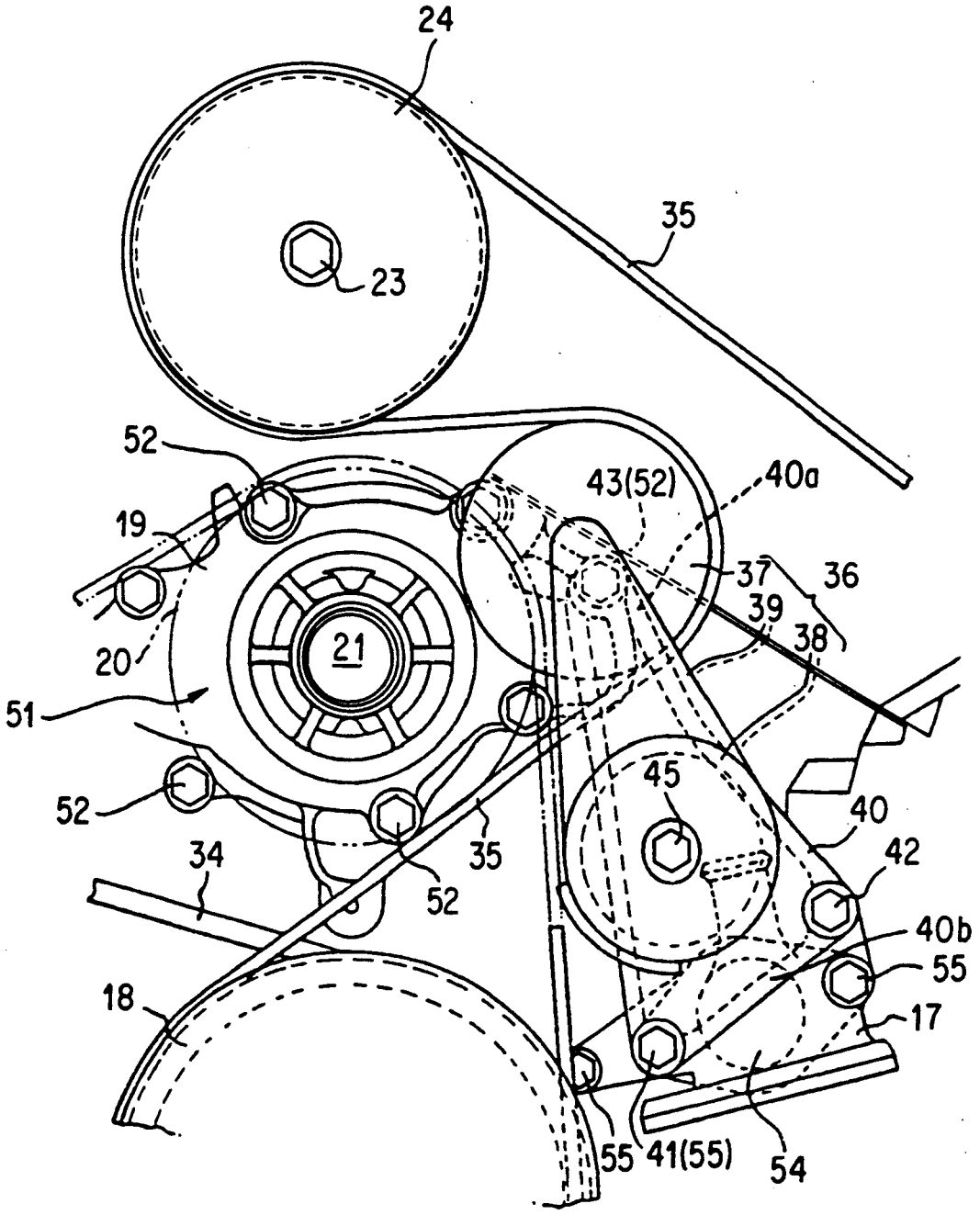
FIG. 3 is an enlarged front view of a bracket and its vicinity as used in the arrangement shown in FIG. 2.
Figure 4:
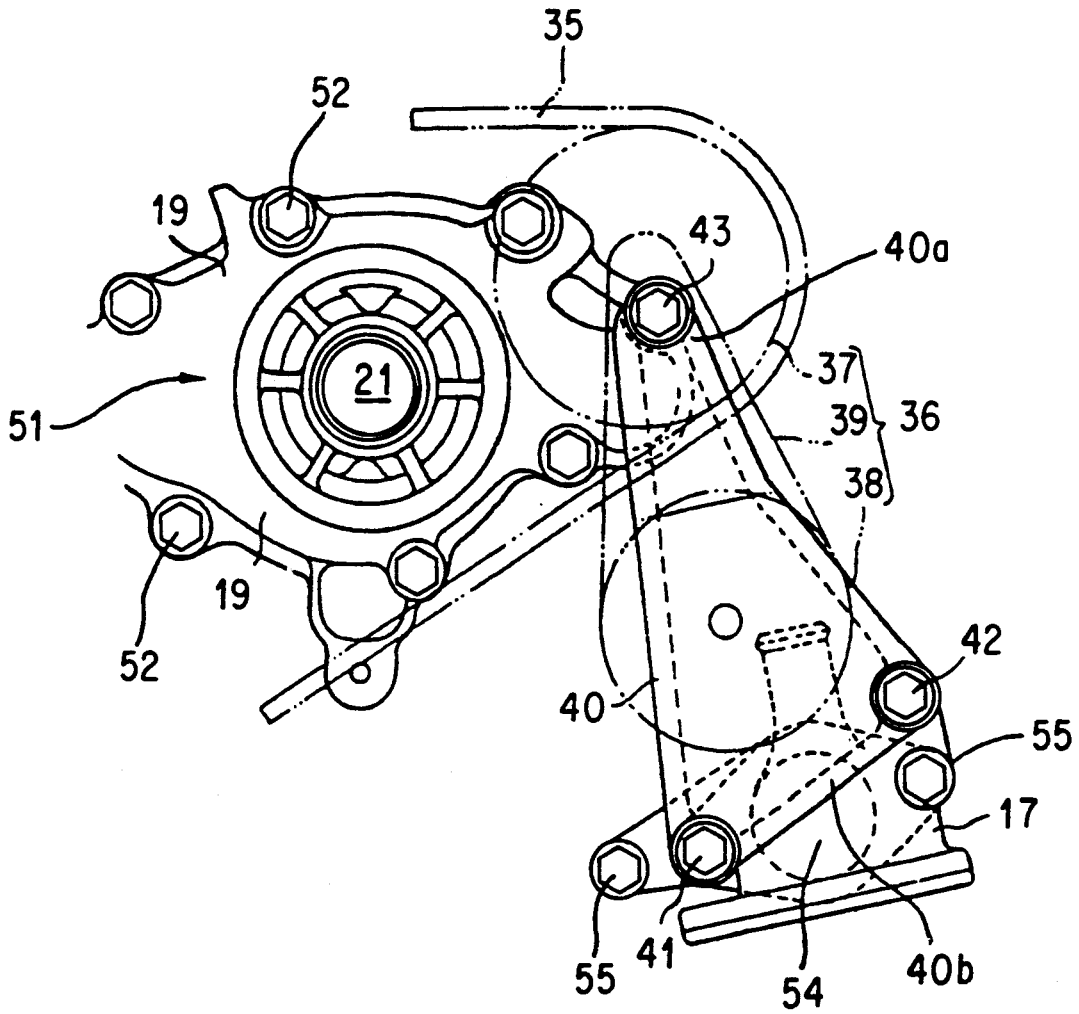
FIG. 4 is an enlarged front view of a bracket and its vicinity, with a tensioner omitted for the sake of clarity, of the arrangement shown in FIG. 2.
Figure 5:
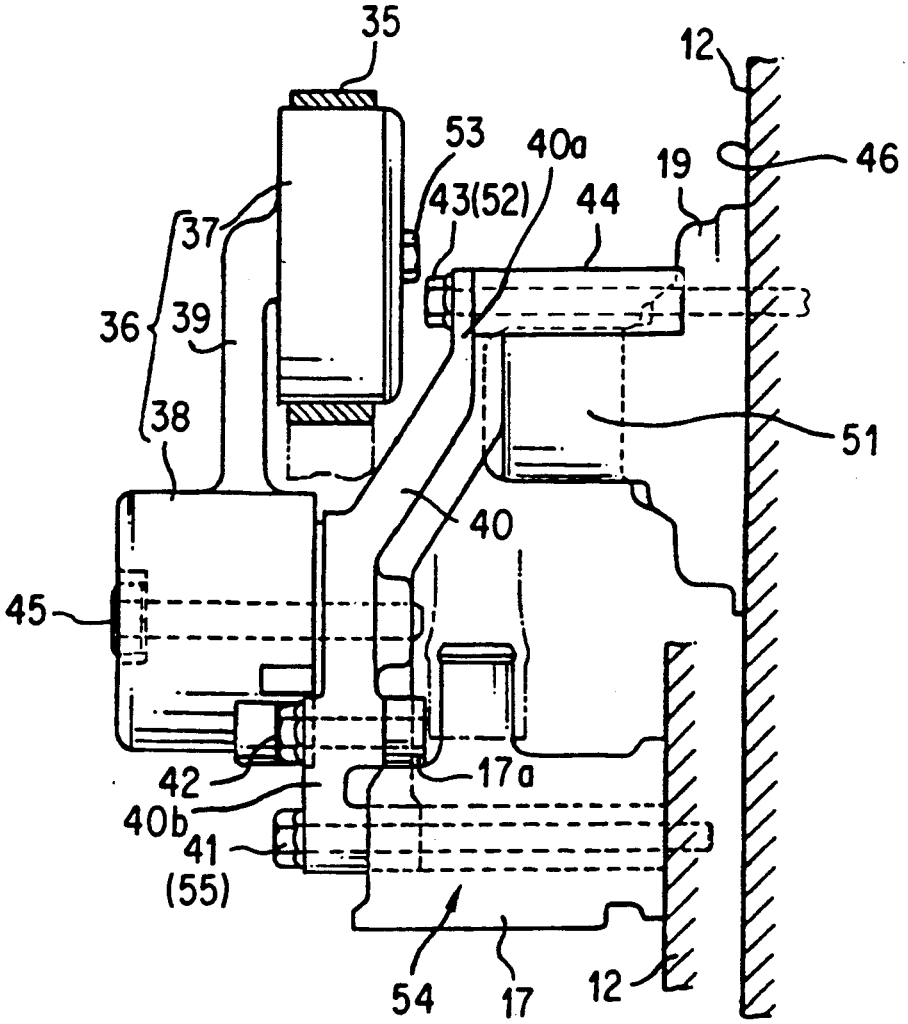
FIG. 5 is an enlarged side view of a bracket and its vicinity as used in the arrangement shown in FIG. 2.

Referring to FIGS. 3 and 5, the automatic tensioning means 36 may be seen to include the tensioning pulley 37, the tensioner body 38 and the tensioner arm 39. The tensioner body 38, which contains an automatic tension regulation mechanism which is well known in the art, is mounted on or supported by a supporting shaft 45. The supporting shaft 45 is secured to a generally triangularly-shaped bracket 40 secured to the front end 46 of the cylinder block 12 by a plurality of fastening bolts. In this embodiment, three fastening bolts 41, 42 and 43 at respective corners of the triangularly-shaped bracket 40 are provided. The arm 39 is formed integrally with or is otherwise secured to the tensioner body 38. The arm 39 extends from the tensioner body 38 and supports, at its top end, a shaft 53 on which the tensioning pulley. 37 is rotatably mounted. As is most clearly seen in FIG. 5, one of the two fastening bolts on the base of the triangularly-shaped bracket, i.e., bolt 41, is used in common as one of at least three fastening bolts 55 which are used to secure the thermostat casing 17 to the cylinder block 12. The other of the two fastening bolts on the base of the triangularly-shaped bracket, bolt 42, is used to secure a lower portion 40*b* of the bracket 40 to a boss 17*a* of the thermostat casing 17. The remaining or uppermost fastening bolt 43 is passed through a cylindrical spacing sleeve 44 and secures the upper portion 40*a* of the bracket 40 to the cylinder block 12. In the illustrated embodiment of the invention, the uppermost fastening bolt 43 is used in common as one of seven fastening bolts 52 for securing the water pump casing 19 to the cylinder block 12. The spacing sleeve 44 is disposed between the bracket 40 and the water pump casing 19 so as to keep the bracket 40 rigidly secured to the uppermost fastening bolt 43 and prevent the bracket 40 from bending under tension applied by the third drive belt 35. In addition to supporting the automatic tensioning means 36, the bracket 40 functions to structurally and mechanically connect the thermostat casing 17 and the water pump casing 19 to each other to improve their structural rigidities.

According to the supplemental apparatus drive arrangement of the present invention, the bracket 40 is secured to the cylinder block 12 by at least the fastening bolts 41 and 42, which are also used to secure the thermostat casing 17 and the water pump casing 19 to the cylinder block 12. The fastening bolts 41 and 42, therefore, mechanically connect the casings 17 and 19 to the cylinder block 12 such that the structural rigidity of the casings 17 and 19 is increased when they are secured to the cylinder block 12.

It is to be noted that although the casings 17 and 19 mentioned above cooperate with an engine coolant passage, a casing cooperating with an engine lubrication oil passage may alternatively be used and formed in the dead portion of the cylinder block In the embodiment of the present invention described above, at least two of a plurality of fastening bolts for securing the bracket supporting the automatic tensioning means 36 to the cylinder block also secure casings, associated with a fluid passage formed in the dead space or unused portion of the cylinder block, to the cylinder block. Consequently, the dead space, which is unavoidably provided due to offsetting rows of cylinders formed in two cylinder banks of the internal combustion engine relative to each other, is not wasted. The casings, moreover, are secured to the engine body with an improved and advantageously high structural firmness, enabling the automatic tensioning means to be formed compactly and supported firmly in a desired position by the bracket.

It is to be understood that although the present invention has been described in detail with respect to a preferred embodiment thereof, various other embodiments and variants may occur to those skilled in the art. Any such other embodiments and variants which fall in the scope and spirit of the present invention are intended to be covered by the following claims.

What is claimed is:

1. An arrangement for driving at least one supplemental apparatus driven by an engine crankshaft through a drive belt placed in front of a front end of a cylinder block of a V-type internal combustion engine, said engine including a pair of cylinder banks, each cylinder bank being formed with a row of cylinders, one row of said cylinders being offset forward in an axial direction of said engine crankshaft with respect to another row of said cylinders, and fluid supply means for supplying at least one of an engine coolant and an engine lubrication oil into said engine, said fluid supply means being installed in a front end portion of the cylinder bank in which the other row of said cylinders is formed, said arrangement comprising:

casing means for covering said fluid supply means;

securing means for securing said casing means to a front end of said front end portion; and tensioning means, supported by said securing means, for applying a tension to said drive belt.

2. An arrangement according to claim 1, wherein said fluid supply means comprises an engine coolant passage for introducing an engine coolant into said cylinder block and a thermostat for regulating the temperature of said engine coolant introduced into said engine coolant passage secured to said front end of said front end portion so as to be in communication with said engine coolant passage.

3. An arrangement according to claim 2, wherein said casing means comprises a thermostat casing for covering said thermostat secured to said front end of said front end portion.

4. An arrangement according to claim 3, wherein said fluid supply means further comprises a water pump for forcing the engine coolant into said engine coolant passage and a pump casing for covering said water pump secured to said front end of said cylinder block.

5. An arrangement according to claim 4, wherein both said thermostat casing and said pump casing are connected by said securing means.

6. An arrangement according to claim 1, wherein said tensioning means comprises an automatic tensioning mechanism for applying a tension to said drive belt and regulating said tension.

7. An arrangement according to claim 1, wherein said fluid supply means comprises an oil passage for introducing engine lubrication oil into said cylinder block.

8. An arrangement according to claim 7, wherein said casing means comprises a casing for covering said oil passage secured to said front end of said front end portion.

9. An arrangement for driving a plurality of supplemental apparatuses divided into at least two groups, the at least two groups of supplemental apparatuses being independently driven by an engine crankshaft of a V-type internal combustion engine through at least two drive belts placed in front of a front end of an engine block of said V-type internal combustion engine so as to be partly overlapped in an axial direction of said engine crankshaft, said V-type internal combustion engine including a pair of cylinder banks, each cylinder bank being formed with a row of cylinders, one row of said cylinders being offset forward in an axial direction of said engine crankshaft with respect to another row of said cylinders, and engine coolant supply means for supplying an engine coolant into said engine block, said engine coolant supply means having a coolant passage formed in a front end portion of the cylinder bank in which the other row of said cylinders is formed, a water pump for forcing the engine coolant into said coolant passage secured to the front end of said engine and a thermostat for regulating the temperature of said engine coolant introduced into said coolant passage secured to a front end of said front end portion, said arrangement comprising:

a thermostat casing for covering said thermostat;

a pump casing for covering said water pump;

securing means for securing said thermostat casing and said pump casing to said front end portion and said front end of said engine, respectively; and automatic tensioning means supported by said securing means for applying a tension to one of said drive belts which is disposed further from said front end of said engine than another of said drive belts.

* * * * *